United States Patent [19]

Prickett

[11] Patent Number: 4,641,144

[45] Date of Patent: Feb. 3, 1987

[54] BROAD BEAMWIDTH LENS FEED

[75] Inventor: Robert J. Prickett, Santa Barbara, Calif.

[73] Assignee: Raytheon Company, Lexington, Mass.

[21] Appl. No.: 687,679

[22] Filed: Dec. 31, 1984

[51] Int. Cl.[4] ..... H01Q 15/04

[52] U.S. Cl. ..... 343/754; 343/911 R

[58] Field of Search ..... 343/753, 754, 911 L, 343/911 R, 909

[56] References Cited

U.S. PATENT DOCUMENTS

| | | | |
|---|---|---|---|
| 3,715,749 | 2/1973 | Archer | 343/5 R |
| 3,761,936 | 9/1973 | Archer et al. | 343/754 |
| 3,964,069 | 6/1976 | McDonough | 343/754 |
| 4,490,723 | 12/1984 | Hardie et al. | 343/754 |

OTHER PUBLICATIONS

"Wide Angle Microwave Lens for Line Source Applications" by W. Rotman an R. F. Turner (*Transactions of Antennas and Propagation*, pp. 623–632, published in Nov. 1963 by the Institute of Electronics Engineers, Inc., New York, N.Y.).

*Primary Examiner*—Eli Lieberman

*Attorney, Agent, or Firm*—Richard M. Sharkansky; Peter J. Devlin

[57] ABSTRACT

A radio frequency antenna system is provided comprising: a radio frequency lens having a parallel plate region and having disposed along opposing peripheral portions thereof a plurality of array ports and a plurality of beam ports, such array ports being coupled to an array of antenna elements arranged to provide a plurality of differently, directed relatively narrow collimated beams of radio frequency energy from a common aperture, each one of such beams being associated with a corresponding one of the plurality of beam ports; and, means for coupling radio frequency energy directly into the parallel plate region to provide, from the common aperture, a relatively broad beam of radio frequency energy.

In a preferred embodiment of the invention, a plurality of amplifiers is provided, each one of the amplifiers being coupled between an array port and a corresponding one of the antenna elements. With such arrangement, the energy fed directly into the parallel plate region to produce the broad beam passes, for amplification, through the plurality of amplifiers thereby increases the power efficiency of the system in producing the broad beam.

3 Claims, 5 Drawing Figures

RADAR SYSTEM
10
12
14a
14j
16a
16j
18a
18j
19a
19j
20
21a
21j
22a
22j
23
25a
25j
27
30
32
34
35
40
42
44
52
60
62a
62b
64a
64f
64j
65a
65f
65j
2

12
30
32
40
42
44
45
47
49
50
52
54
56
58
60
64f
65f

BROAD BEAMWIDTH LENS FEED

BACKGROUND OF THE INVENTION

This invention relates generally to radio frequency antennas and more particularly to radio frequency lens type radio frequency antennas.

As is known in the art, an antenna may be arranged so that it produces a plurality of simultaneously existing beams of radio frequency energy with each one of such beams having the gain and bandwidth of the entire antenna aperture. According to the art, a desired number of simultaneous beams may be obtained by connecting each one of a plurality of antenna elements in an array thereof through a constrained electrical path to a plurality of beam ports, the constrained electrical path being made up of an electromagnetic lens which equalizes the time delay of the electromagnetic energy between any given one of a number of beam ports and all points on corresponding planar wave fronts of transmitted energy. Any one of a variety of known electromagnetic lenses may be used. One such lens is a so called "Rotman" lens described in a paper entitled "Wide Angle Microwave Lens for Line Source Applications" by W. Rotman and R. F. Turner (*Transactions of Antennas and Propagation,* pp. 623–632, published in November 1963 by the Institute of Electrical and Electronics Engineers, Inc., New York, New York). Another such lens is described in U.S. Pat. No. 3,761,936 issued Sept. 25, 1973, entitled "Multi-Beam Array Antenna" inventors Donald H. Archer, Robert J. Prickett and Curtis P. Hartwig and assigned to the same assignee as the present invention. With either one of such lenses, a lens shaped, parallel plate region is provided with a plurality of beam ports and a plurality of array ports being disposed about opposing peripheral portions of the region. Each one of the array ports is coupled to a corresponding one antenna element in an array of antenna elements and each one of the beam ports is associated with a corresponding one of a plurality of differently directed, relatively narrow beams of radio frequency energy.

When used as a transmitting antenna system, an amplifier, typically a travelling wave tube (TWT) amplifier, is coupled between each one of the array ports and a corresponding one of the antenna elements. While such arrangement thus provides a plurality of differently directed, relatively narrow transmitted beams, in some applications it is desirable to transmit a broad or "flood" beam. Such flood beams have been produced by by-passing the parallel plate lens and feeding the radio frequency signal to only a single antenna element via the input to the amplifier feeding such single antenna element. With such arrangement, however, the system radiated power efficiency suffers because the power from the other amplifiers in the system is not used in producing the "flood" beam.

SUMMARY OF THE INVENTION

In accordance with the present invention, a radio frequency antenna system is provided comprising: a radio frequency lens having a parallel plate region and having disposed along opposing peripheral portions thereof a plurality of array ports and a plurality of beam ports, such array ports being coupled to an array of antenna elements arranged to provide a plurality of differently, directed, relatively narrow collimated beams of radio frequency energy from a common aperture, each one of such beams being associated with a corresponding one of the plurality of beam ports; and, means for coupling radio frequency energy directly into the parallel plate region to provide, from the common aperture, a relatively broad beam of radio frequency energy.

In a preferred embodiment of the invention, a plurality of amplifiers is provided, each one of the amplifiers being coupled between an array port and a corresponding one of the antenna elements. With such arrangement, the energy fed directly into the parallel plate region to produce the broad beam passes, for amplification, through the plurality of amplifiers thereby increases the power efficiency of the system in producing the broad beam.

BRIEF DESCRIPTION OF THE DRAWINGS

The aforementioned aspects and other features of the invention are explained in the following description taken in connection with the accompanying drawings in which.

DESCRIPTION OF THE PREFERRED EMBODIMENT

Figure 1:
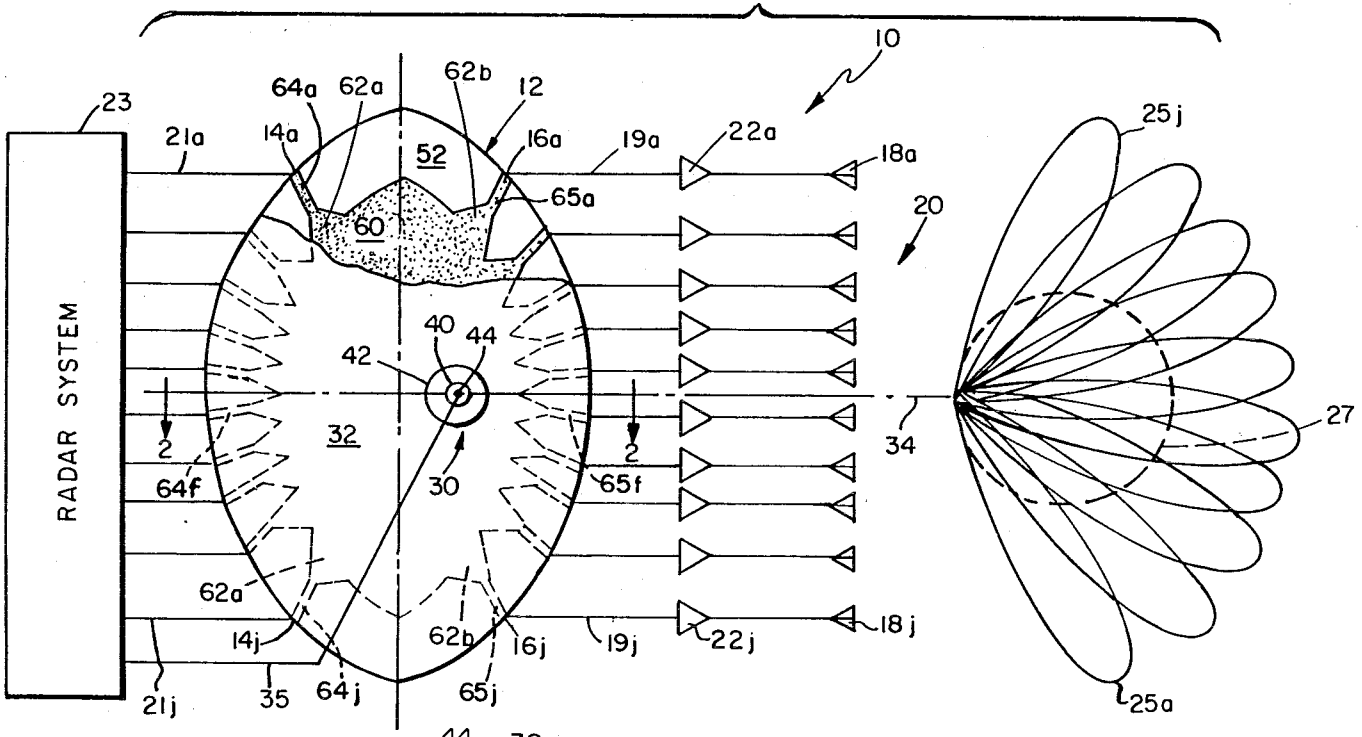
FIG. 1 is a partially schematic drawing of a multibeam radio frequency energy system using a radio frequency lens according to the invention, such drawing showing a plan view of such lens.

Referring now to FIG. 1, a radio frequency antenna system 10 is shown to include a parallel plate radio frequency lens 12 having disposed along opposing peripheral portions thereof a plurality of, here ten, beam ports **14*a*–14*j* and a plurality of array ports 16*a*–16*j*. The plurality of beam ports 14*a*–14*j* is coupled in a conventional manner, here by conventional coaxial cables 21*a*–21*j*, to a radar system 23. The plurality of array ports 16*a*–16*j* is coupled to a corresponding plurality of antenna elements 18*a*–18*j*. The antenna elements 18*a*–18*j* are disposed to form an array 20. A corresponding one of a plurality of amplifiers 22*a*–22*j* is coupled between one of the array ports 16*a*–16*j* and the one of the antenna elements 18*a*–18*j* coupled to such one of the array ports 16*a*–16*j*. The shape of the lens 12, the lengths of the electrical conductors, here coaxial cables 19*a*–9*j*, interconnecting the array ports 16*a*–16*j*, the amplifiers 22*a*–22*j* and the antenna elements 18*a*–18*j* along with the arrangement of the antenna elements 18*a*–18*j* in the array 20 are selected to provide, for radar system 23**, a plurality of, here ten, simultaneously existing, collimated, differently directed, relatively narrow beams 25*a*–25*j*, respectively, of radio frequency energy, from a common aperture. Each one of the ten beams has a direction associated with one of the ten beam ports 14*a*–14*j*, as described in U.S. Pat. No. 3,715,749, inventor Donald H. Archer, issued Feb. 6, 1973 and assigned to the same assignee as the present invention. Here a feed 30 is provided for coupling radio frequency energy directly into the parallel plate region 32 of lens 12 to create a "flood" or broad beam 27 from the common aperture provided by the array of antenna elements. The feed 30 is coupled to radar system 23 via conventional coaxial cable 35. The feed 30 is located at a point in the boresight axis 34 of parallel plate region 32 of the lens 12 such that the amplitudes of the energy radiated by each of the array elements 18*a*–18*j* are nearly equal. The point at which the feed 30 is disposed along the boresight axis 34 is selected empirically so that, in response to the energy fed to feed 30, a quadratic phase taper is created across the array which broadens the narrow beam from that which is produced from energy fed to one of the beam ports 14*a*–14*j*.

Figure 2:
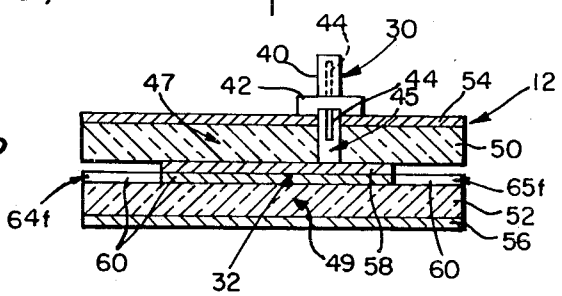
FIG. 2 is a schematic, an elevation, cross-sectional view of the lens of FIG. 1, such elevation cross-section being distorted with the vertical dimensions being greatly enlarged compared to the horizontal dimensions, such cross-section being taken along the boresight axis 2—2 of FIG. 1.
Figure 3:
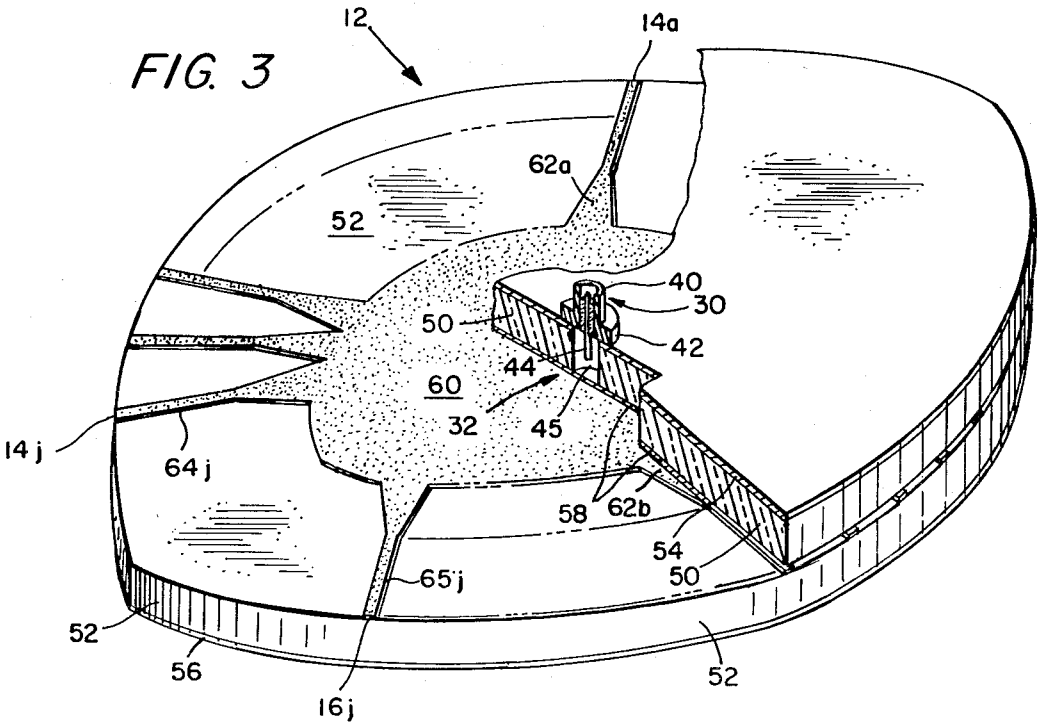
FIG. 3 is an isometric, partially broken array, schematic drawing of the lens of FIGS. 1 and 2.

Referring now also to FIG. 2, the feed 30 and the parallel plate radio frequency lens 12 are shown in detail. Here the feed 30 is a coaxial connector having an outer conductor 40 electrically connected to a disc shaped mounting flange 42 having mounting surfaces disposed perpendicular to the longitudinal axis of the coaxial connector feed 30. The inner center conductor 44 is insulated, in a conventional manner, from the outer conductor 40. Here the parallel plate lens 12 is a strip transmission line lens having a pair of dielectric substrates 50, 52, each having a ground plane conductor 54, 56, respectively, clad to the outer surfaces thereof, and substantially identical (mirror imaged) center conductor circuitry 58, 60, respectively, disposed on the inner surfaces thereof. The center conductor circuitry 58, 60 is formed by etching copper clad surfaces formed on the inner surfaces of the dielectric substrates 50, 52 using conventional photolithographic-chemical etching techniques. The center conductor circuitry 58, 60 formed on the inner surface of each of the substrates 50, 52 is patterned in accordance with U.S. Pat. No. 3,761,936 referred to above and thus, as described therein each has a parallel plate lens region 32 with triangular shaped matching sections formed 62*a*, 62*b* along the focal area of the parallel plate lens region 32. It is noted that while each of the substrates 50, 52 has patterned on the inner surfaces thereof a mirror imaged parallel plate region 32 and triangular shaped matching sections 62*a*, 62*b*, only the lower substrate 52 has formed on the inner surface thereof strip transmission lines 64*a*–64*j* which are disposed between the apex of each one of the triangular shaped matching sections 62*a* and a corresponding one of the beam ports 14*a*–14*j*. Likewise, only substrate 52 has formed on the inner surface thereof strip transmission lines 65*a*–65*j* which are disposed between the apex of each one of the triangular shaped matching sections 62*b* formed on substrate 52 and a corresponding one of the array ports 16*a*–16*b*. As shown, here the conductive mounting flange 40 of the feed 30 is electrically connected to the ground plane conductor 54 formed on dielectric substrate 50. The portion of the ground plane conductor 54 and the portion of the dielectric of the substrate 50 disposed beneath the center of the coaxial connector 30 is removed, here drilled away, to form a cylindrical compartment 45 to receive the center conductor 44. Thus, the feed 30 launches energy directly into the parallel plate region 32 in the TEM mode with the electric field of such energy being within the regions, 47, 49 disposed between the mutually bonded strip conductor circuitry 58, 60 and the ground plane conductors 54, 56. It has been found that only a single feed 30 need be used to produce a flood beam and also that the center conductor 44 may extend either part way into the dielectric 50 of the parallel plate region 32 (that is the tip of the center conductor spaced from circuitry 58) or could extend completely through the dielectric 50 so that the tip of the center conductor 44 physically (and hence electrically) contacts the strip conductive circuitry 58 formed on the inner surface of the substrate 50. The depth of penetration into dielectric 50 of the center conductor 44 is a function of the degree of coupling desired. The feed 30 would normally be positioned along the boresight axis 34 (FIG. 1) of lens 12. Its position along that axis 34 is empirically determined to provide the optimum flood beam over the frequency range which the lens is to operate.

Figure 4:
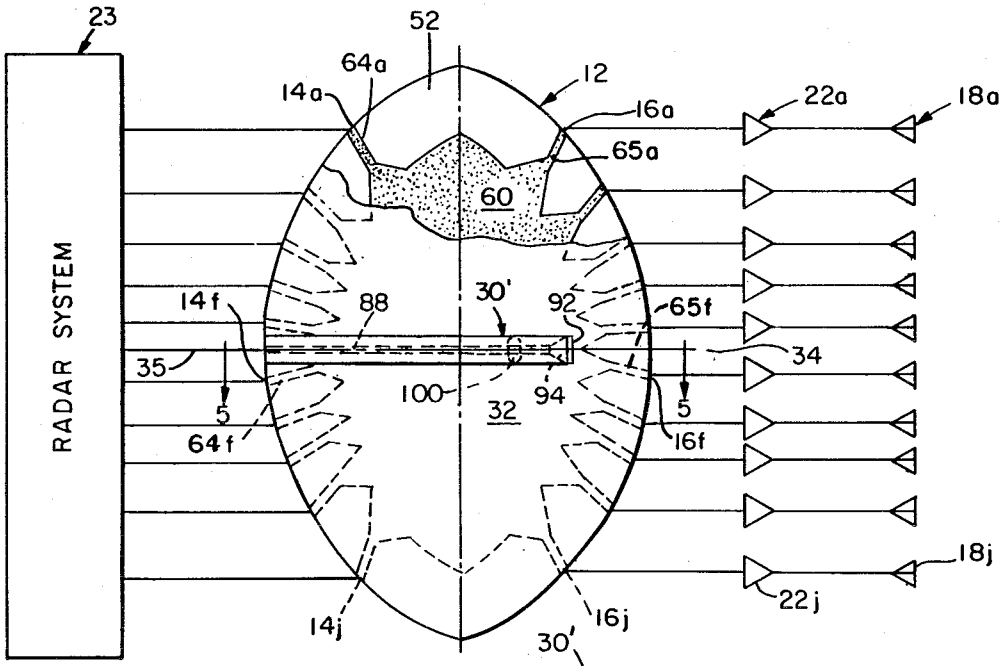
FIG. 4 is a partially schematic drawing of a multibeam radio frequency system using a radio frequency lens according to an alternative embodiment of the invention, such drawing showing a plan view of such lens.
Figure 5:
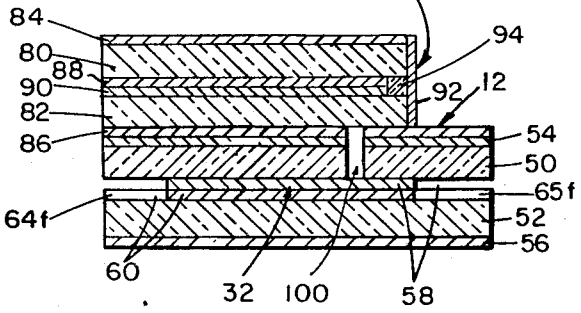
FIG. 5 is a schematic, cross sectional view of the lens of FIG. 1, such elevation cross-section being distorted with the vertical dimensions being greatly enlarged compared to the horizontal dimensions, such cross-section being taken along the boresight axis 5—5 of FIG. 4.

Feeds other than a coaxial connector 30 may be used. For example, referring now to FIGS. 4 and 5, an alternate feed 30′ is used. Here, such feed 30′ is a strip transmission line feed having a pair of dielectric substrates 80, 82, each having outer ground plane conductors 84, 86, respectively, clad to the outer surfaces thereof and each having a strip conductor 88, 90 on the inner surfaces thereof. The strip conductors 88, 90 are disposed one on top of the other in a conventional manner. A coupling slot 100 is formed in the dielectric substrate 50, ground plane conductors 54 and ground plane conductor 86. A conductive back wall 92 is provided around the ends of the dielectric 80, 82 to electrically connect the ground plane conductors 84, 86. A triangular shaped radio frequency energy absorber 94 is disposed between the ends of strip conductors 88, 90 and the back wall conductor 92 to provide a matched load for the strip transmission line. Thus, radio frequency energy fed into the strip transmission line from radar system 23 via cable 35 is coupled directly into the parallel plate region 32 via slot 100. (It is noted that instead of absorber 94, a conventional 50 ohm chip resistor may be used to match terminate the strip transmission line).

Thus, it is noted that with either feed, 30, 30′ since such feed 30, 30′ is located at a point interior to the parallel plate region 32 a "flood" or broad beam 27 (FIG. 1) is provided from energy which passes to all of the array elements 18*a*–18*j* via amplifiers 22*a*–22*j*.

Having described preferred embodiments of the invention, it will now be evident that many other changes and modifications may me made without departing from the inventive concepts therein. Further, while the antenna system here has been shown as a transmitting system, the system may be easily modified into a receiving system by removing the amplifiers and coupling the array ports directly to the array antenna elements. The feed 30, 30′ directly coupled to the parallel plate region thus receives energy over a broad beam, as in a search mode, and the beam ports 14*a*–14*j* being used for determining the angle of arrival of the received energy as in a track mode. The track mode may be initiated in response to detected energy received by the feed 30, 30′ during the search mode. It is felt, therefore, that this invention should not be restricted to its described embodiments but rather should be limited only by the spirit and scope of the appended claims.

What is claimed is:

1. A radio frequency antenna system comprising:

a radio frequency lens having a parallel plate region and having disposed along opposing peripheral portions thereof a plurality of array ports and a plurality of beam ports, such array ports being coupled to an array of antenna elements arranged to provide a plurality of differently, directed, relatively narrow collimated beams of radio frequency energy from a common aperture, each one of such beams being associated with a corresponding one of the plurality of beam ports; and, means for coupling radio frequency energy directly into an interior portion of the parallel plate region to provide, from the common aperture, a relatively broad beam of radio frequency energy.

2. The system recited in claim 1 including a plurality of amplifiers, each one of the amplifiers being coupled between an array port and a corresponding one of the antenna elements.

3. The system recited in claim 1 wherein the coupling means includes means for coupling energy in the TEM mode to the parallel plate region.

* * * * *